US007852006B2

(12) United States Patent
Bewlay et al.

(10) Patent No.: US 7,852,006 B2
(45) Date of Patent: Dec. 14, 2010

(54) CERAMIC LAMP HAVING MOLYBDENUM-RHENIUM END CAP AND SYSTEMS AND METHODS THEREWITH

(75) Inventors: Bernard Patrick Bewlay, Schenectady, NY (US); Bruce Alan Knudsen, Amsterdam, NY (US); Mohamed Rahmane, Clifton Park, NY (US); James Anthony Brewer, Scotia, NY (US); James Scott Vartuli, Rexford, NY (US); Alan George Chalmers, Akron, OH (US)

(73) Assignee: General Electric Company, Niskayuna, NY (US)

( * ) Notice: Subject to any disclaimer, the term of this patent is extended or adjusted under 35 U.S.C. 154(b) by 672 days.

(21) Appl. No.: 11/172,649

(22) Filed: Jun. 30, 2005

(65) Prior Publication Data

US 2007/0001610 A1 Jan. 4, 2007

(51) Int. Cl.
*H01J 17/16* (2006.01)

(52) U.S. Cl. ..... 313/634; 313/635; 313/636; 445/26

(58) Field of Classification Search ..... 313/634–636; 445/26

See application file for complete search history.

(56) References Cited

U.S. PATENT DOCUMENTS

| | | | | |
|---|---|---|---|---|
| 3,363,134 | A | 1/1968 | Johnson | |
| 3,385,463 | A | 5/1968 | Lange | |
| 3,659,138 | A | 4/1972 | Johnson et al. | |
| 3,662,455 | A | 5/1972 | Anderson | |
| 3,693,007 | A | 9/1972 | Kerekes | |
| 3,716,743 | A | 2/1973 | Mizuno et al. | |
| 3,872,341 | A | 3/1975 | Werner et al. | 313/217 |
| 3,882,344 | A | 5/1975 | Knochel et al. | 313/217 |
| 3,882,346 | A | 5/1975 | McVey | 313/253 |
| 3,953,177 | A | 4/1976 | Sedlatschek et al. | |
| 4,103,200 | A | 7/1978 | Bhalla | 313/221 |
| 4,291,250 | A | 9/1981 | Bhalla | 313/220 |
| 4,409,517 | A | 10/1983 | Van Der Sande et al. | |
| 4,464,603 | A | 8/1984 | McVey | |
| 4,507,584 | A | 3/1985 | Coaton et al. | |
| 4,545,799 | A | 10/1985 | Rhodes et al. | |
| 4,585,972 | A | 4/1986 | Hing | |
| 4,707,636 | A | 11/1987 | Morris | |
| 4,780,646 | A | 10/1988 | Lange | |
| 4,804,889 | A | 2/1989 | Reid et al. | 313/624 |
| 5,057,048 | A | 10/1991 | Feuersanger et al. | |
| 5,321,335 | A | 6/1994 | Klug et al. | |
| 5,424,609 | A | 6/1995 | Geven et al. | |

(Continued)

FOREIGN PATENT DOCUMENTS

| | | |
|---|---|---|
| EP | 0887840 | 12/1998 |

(Continued)

OTHER PUBLICATIONS

U.S. Appl. No. 10/738,261, filed Dec. 17, 2003, Bewlay et al.

(Continued)

*Primary Examiner*—Bumsuk Won
(74) *Attorney, Agent, or Firm*—Francis T. Coppa

(57) ABSTRACT

A lamp comprising an arc envelope and a molybdenum-rhenium end structure coupled to the arc envelope.

31 Claims, 9 Drawing Sheets

U.S. PATENT DOCUMENTS

| | | | | |
|---|---|---|---|---|
| 5,426,343 | A | 6/1995 | Rhodes et al. | |
| 5,552,670 | A | 9/1996 | Heider et al. | |
| 5,725,827 | A | 3/1998 | Rhodes et al. | |
| 5,783,907 | A | 7/1998 | Suzuki et al. | |
| 5,973,453 | A | 10/1999 | Van Viet et al. | |
| 5,994,839 | A | 11/1999 | Yamamoto et al. | |
| 6,069,456 | A | 5/2000 | Fromm et al. | |
| 6,126,889 | A | 10/2000 | Scott et al. | |
| 6,215,254 | B1 | 4/2001 | Honda et al. | |
| 6,216,889 | B1 | 4/2001 | Chang | |
| 6,265,827 | B1 | 7/2001 | Takahashi et al. | |
| 6,294,871 | B1 | 9/2001 | Scott et al. | |
| 6,300,716 | B1 | 10/2001 | Honda et al. | |
| 6,375,533 | B1 | 4/2002 | Torikai et al. | |
| 6,404,129 | B1 | 6/2002 | Hendricx et al. | |
| 6,528,945 | B2 | 3/2003 | Kelly et al. | |
| 6,583,563 | B1 | 6/2003 | Venkataramani et al. | |
| 6,635,993 | B1 | 10/2003 | Niimi | |
| 6,642,654 | B2 | 11/2003 | Niimi | |
| 6,657,388 | B2 | 12/2003 | Wijenberg et al. | |
| 6,750,612 | B2 | 6/2004 | Takagaki et al. | |
| 6,781,292 | B2 | 8/2004 | Ishida et al. | |
| 6,791,267 | B2 | 9/2004 | Niimi | |
| 6,812,642 | B1 | 11/2004 | Niimi | 313/623 |
| 6,815,894 | B2 | 11/2004 | Takagaki et al. | |
| 6,873,109 | B2 | 3/2005 | Ishigami et al. | |
| 2002/0027421 | A1 | 3/2002 | Kaneko et al. | |
| 2002/0117965 | A1* | 8/2002 | Kotter et al. | 313/573 |
| 2002/0195941 | A1* | 12/2002 | Yang | 313/625 |
| 2004/0108814 | A1 | 6/2004 | Tsuda et al. | |
| 2004/0119413 | A1* | 6/2004 | Kebbede et al. | 313/624 |
| 2004/0119414 | A1* | 6/2004 | Bewlay et al. | 313/636 |
| 2004/0124776 | A1* | 7/2004 | Iorio et al. | 313/625 |
| 2004/0135510 | A1 | 7/2004 | Bewlay et al. | 313/624 |
| 2004/0174121 | A1 | 9/2004 | Tsuda et al. | |
| 2004/0183446 | A1 | 9/2004 | Grundmann et al. | |
| 2005/0007020 | A1 | 1/2005 | Tsuda et al. | |
| 2005/0174053 | A1* | 8/2005 | Gunter | 313/567 |
| 2006/0001346 | A1 | 1/2006 | Vartuli et al. | |
| 2006/0008677 | A1 | 1/2006 | Bewlay et al. | |
| 2006/0012306 | A1 | 1/2006 | Bewlay et al. | |
| 2006/0022596 | A1* | 2/2006 | Watanabe et al. | 313/623 |
| 2006/0202624 | A1* | 9/2006 | Ramaiah et al. | 313/625 |

FOREIGN PATENT DOCUMENTS

| | | |
|---|---|---|
| EP | 0935278 | 8/1999 |
| EP | 1150337 | 10/2001 |
| EP | 1158567 | 11/2001 |
| EP | 1172839 | 1/2002 |
| EP | 1172840 | 1/2002 |
| EP | 1220295 | 7/2002 |
| EP | 1253616 | 10/2002 |
| EP | 1296355 | 3/2003 |
| EP | 1310983 | 5/2003 |
| EP | 1351276 | 10/2003 |
| EP | 1363313 | 11/2003 |
| EP | 1434247 | 6/2004 |
| JP | 2004214194 | 7/2004 |
| WO | WO9825294 | 6/1998 |
| WO | WO03058674 | 7/2003 |
| WO | WO03099741 | 12/2003 |
| WO | WO2004023517 | 3/2004 |
| WO | WO2004049390 | 6/2004 |
| WO | WO2004049391 | 6/2004 |
| WO | WO2004051699 | 6/2004 |
| WO | WO2004051700 | 6/2004 |
| WO | WO2004102614 | 11/2004 |
| WO | 2006046172 | 5/2006 |

OTHER PUBLICATIONS

U.S. Appl. No. 10/984,593, filed Nov. 9, 2004, Loureiro et al.
U.S. Appl. No. 11/289,128, filed Nov. 29, 2005, Bewlay et al.
U.S. Appl. No. 11/172,650, filed Jun. 30, 2005, Bewlay et al.
U.S. Appl. No. 11/172,651, filed Jun. 30, 2005, Bewlay et al.
Tokumatsu Tachiwaki et al., "*Novel Synthesis of $Y_3Al_5O_{12}$ (YAG) Leading to Transparent Ceramics*", Solid State Communications, vol. 119, pp. 603-606, 2001.
Lei Wen et al., "*Synthesis of Nanocrystalline Yttria Powder and Fabrication of Transparent YAG Ceramics*", Journal of the European Ceramic Society, vol. 24, pp. 2681-2688, 2003.
D. Hreniak et al., "*Synthesis and Optical Properties of $Nd^3$+—Doped $Y_3Al_5O_{12}$ Nanoceramics*", Journal of Alloys and Compounds, vol. 341, pp. 183-186, 2002.
Guanshi Qin et al., "*Upconversion Luminescence of $Er^3$+ In Highly Transparent YAG Ceramics*", Solid State Communications, vol. 132, pp. 103-106, 2004.
Jianren Lu et al., "*Neodymium Doped Yttrium Aluminum Garnet ($Y_3Al_5O_{12}$) Nanocrystalline Ceramics—A New Generation of Solid State Laser and Optical Materials*", Journal of Alloys and Compounds, vol. 341, pp. 220-225, 2002.
A.K. Pradhan et al., "*Synthesis of Neodymium-Doped Yttrium Aluminum Garnet (YAG) Nanocrystalline Powders Leading to Transparent Ceramics*", Materials Research Bulletin, vol. 39, pp. 1291-1298, 2004.
U.S. Appl. No. 10/952,940, filed Sep. 29, 2004, Bewlay et al.
PCT Search Report PCT/US2006/023798, Jun. 2, 2009.
PCT Written Opinion, PCT/US2009/023798, Jun. 2, 2009.

* cited by examiner

CERAMIC LAMP HAVING MOLYBDENUM-RHENIUM END CAP AND SYSTEMS AND METHODS THEREWITH

BACKGROUND

The present technique relates generally to the field of lighting systems and, more particularly, to high intensity discharge lamps.

High intensity discharge lamps are often formed from a ceramic tubular body or arc tube that is sealed to one or more end caps or end structures. High intensity discharge lamps generally operate at high temperatures and high pressures. Because of operational limitations, various parts of these lamps are made of different types of materials. The process of joining different materials in high-temperature lamps creates significant challenges. Specifically, the different thermal coefficients of expansion of these joined materials can lead to thermal stresses and cracks during operation of the lamp. For example, thermal stresses and cracks can develop at the seal interface between the different components, e.g., arc tube, electrodes, end caps, and so forth. Certain end-cap materials used to provide favorable and reliable stress distribution in the ceramic at the end of the ceramic lamp, unfortunately, are not chemically resistant to halide species that may be used in the lamps, especially at elevated temperatures.

Typically, high intensity discharge lamps are assembled and dosed in a dry box, which facilitates control of the atmosphere. For example, in the controlled environment within the dry box, the lamp end-caps are attached to an arc tube with the assistance of a furnace, which is also disposed within the dry box. The assembly of seal material, end-caps and arc tube is inserted into a furnace and the furnace is operated through a controlled temperature cycle. The controlled temperature cycle is designed in conjunction with a temperature gradient at the end of the furnace to melt the seal material (typically a dysprosia-alumina-silica mixture), which then flows through the gap between components to seal the end-caps to the arc tube. Typically, a furnace such as a large muffle type furnace with temperatures reaching to about 1500 degrees centigrade or higher is used to seal the lamp components. The assembly is typically held at the temperature for about 30 seconds to about 45 seconds, then the temperature of the assembly is lowered to room temperature to seal the end structures to the arc envelope. Unfortunately, this requirement of a dry box environment with a furnace disposed within the box severely limits production efficiency of the lamps. For some lamp applications, it is desirable to have a room temperature pressure of 10 to 20 atmospheres to better enable rapid start-up. Dry box processing makes it difficult to seal lamps with such high pressure fills.

Accordingly, a technique is needed to address one or more of the foregoing problems in lighting systems, such as high-intensity discharge lamps.

BRIEF DESCRIPTION

Embodiments of the present invention provide a ceramic lamp with a molybdenum-rhenium end structure capable of improved performance, such as light output, color stability, reliability, and life, over the existing traditional technologies. Certain embodiments of the lamp have an arc envelope and a molybdenum-rhenium end structure bonded to the arc envelope with the end structure overlapping an outer-perimeter of the arc envelope. Another embodiment is a system, which has an end structure comprising molybdenum-rhenium, a ceramic arc envelope coupled to the end structure, a dosing tube extending through the end structure and a dosing material disposed within the arc envelope. In another embodiment, the present technique includes the method for making a lamp with an arc envelope bonded to a molybdenum-rhenium end structure, with a dosing material disposed within the arc envelope. In a further embodiment, the present technique includes a method for operating a lamp with an arc envelope bonded to a molybdenum-rhenium end structure. In a still further embodiment is a method of making a molybdenum rhenium end structure.

DRAWINGS

These and other features, aspects, and advantages of the present invention will become better understood when the following detailed description is read with reference to the accompanying drawings in which like characters represent like parts throughout the drawings, wherein.

Figure 3:
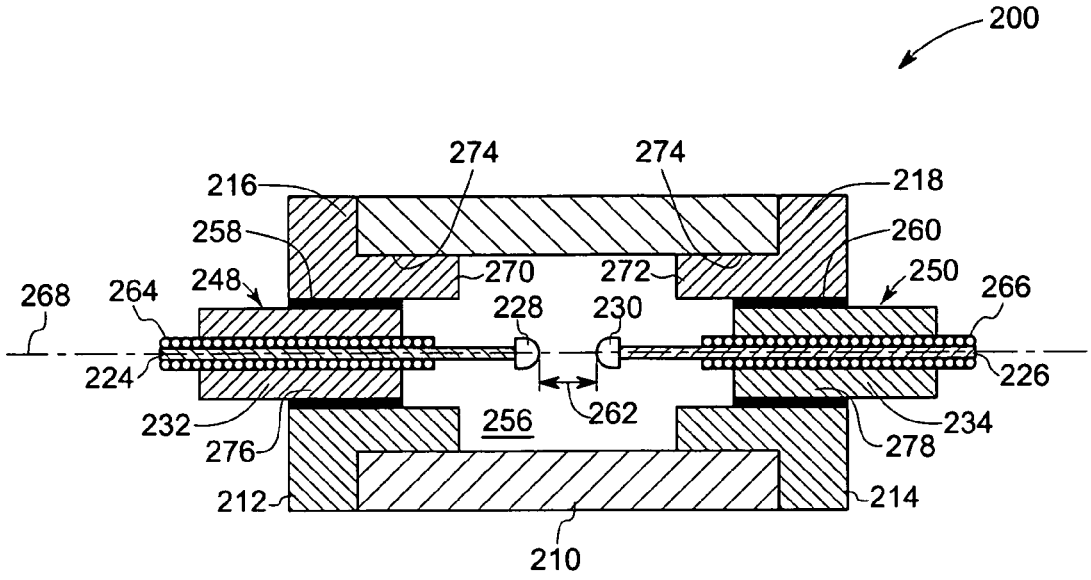
FIG. 3 is a cross-sectional view of a lamp having an arc envelope, end structures coupled to (and extending into) opposite ends of the arc envelope, and a dosing tube coupled to each end structure in accordance with embodiments of the present technique.
Figure 8:
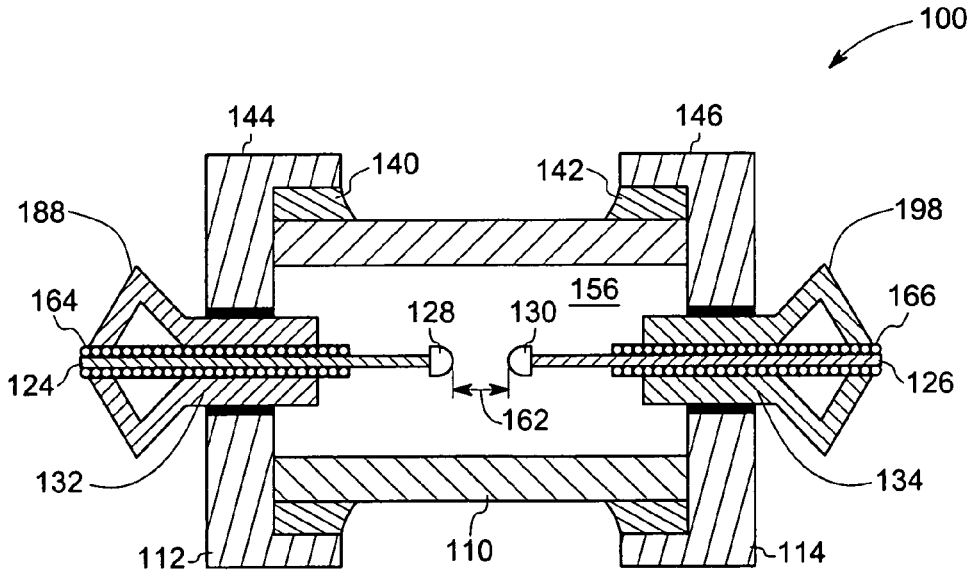
Figure 9:
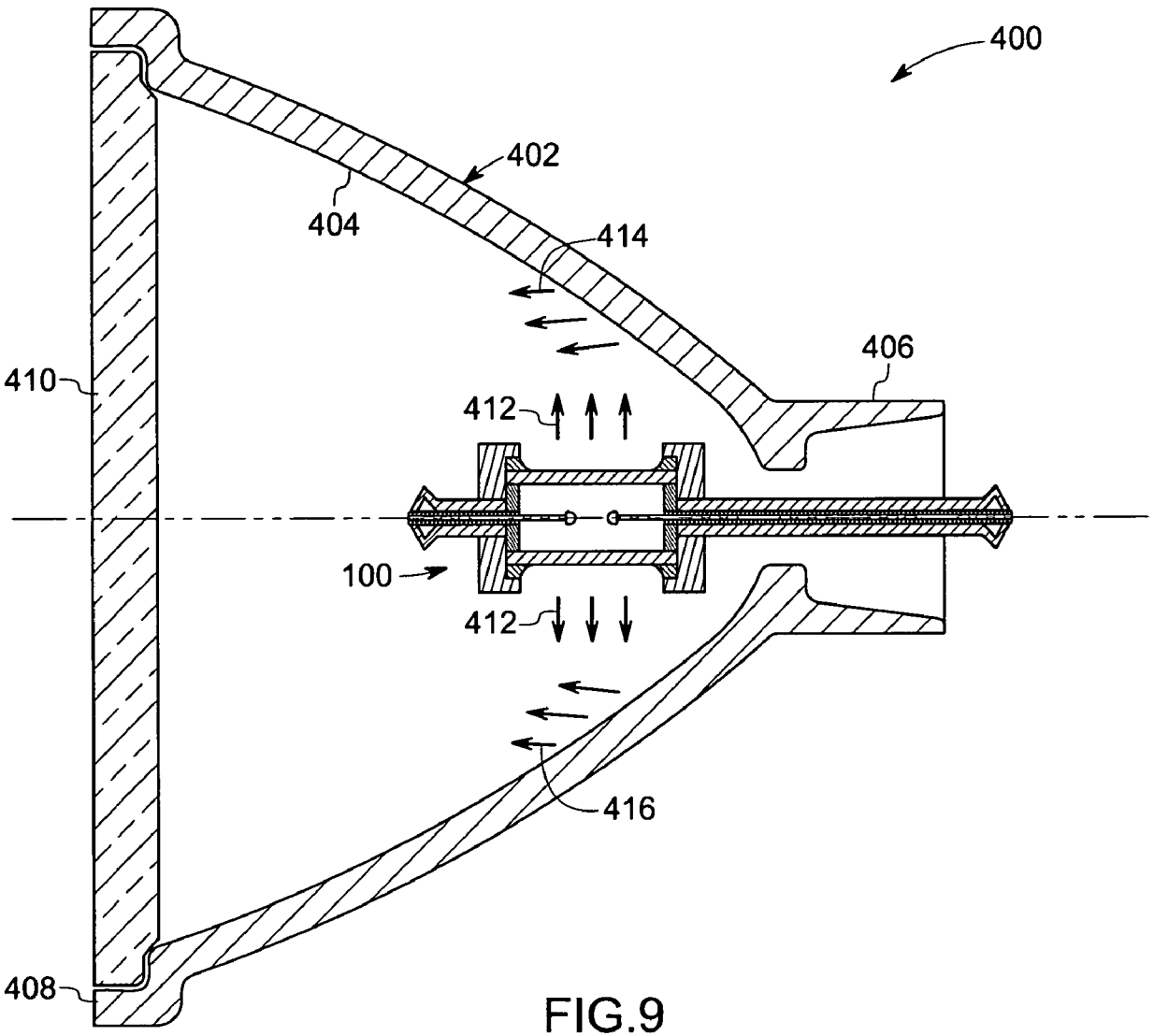
Figure 10:
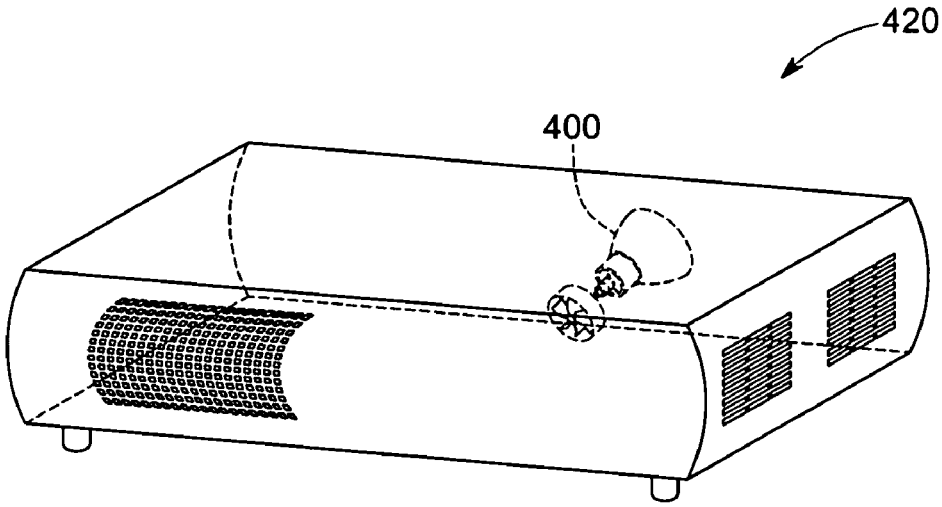
Figure 11:
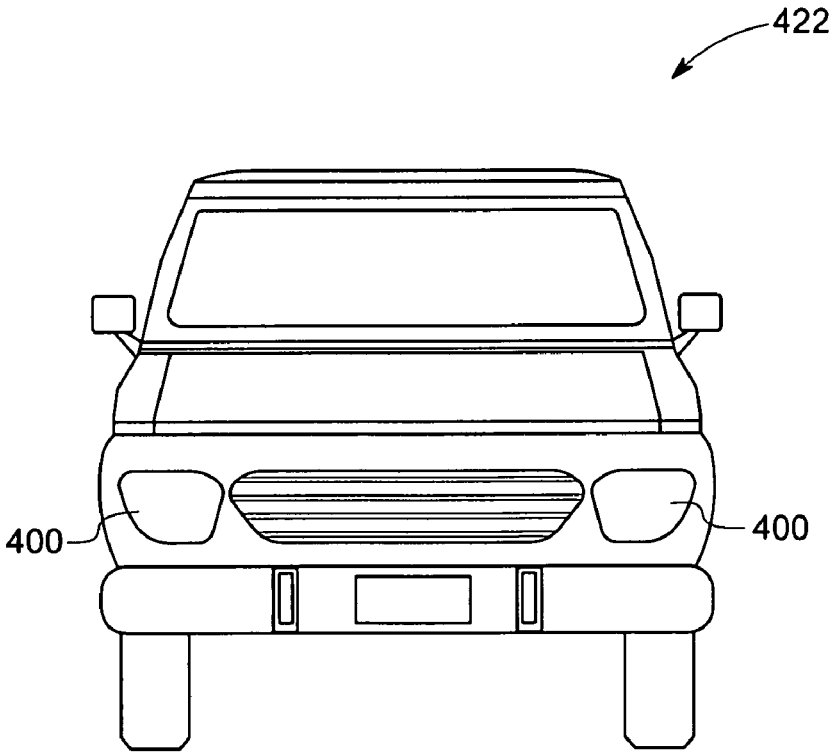
Figure 14:
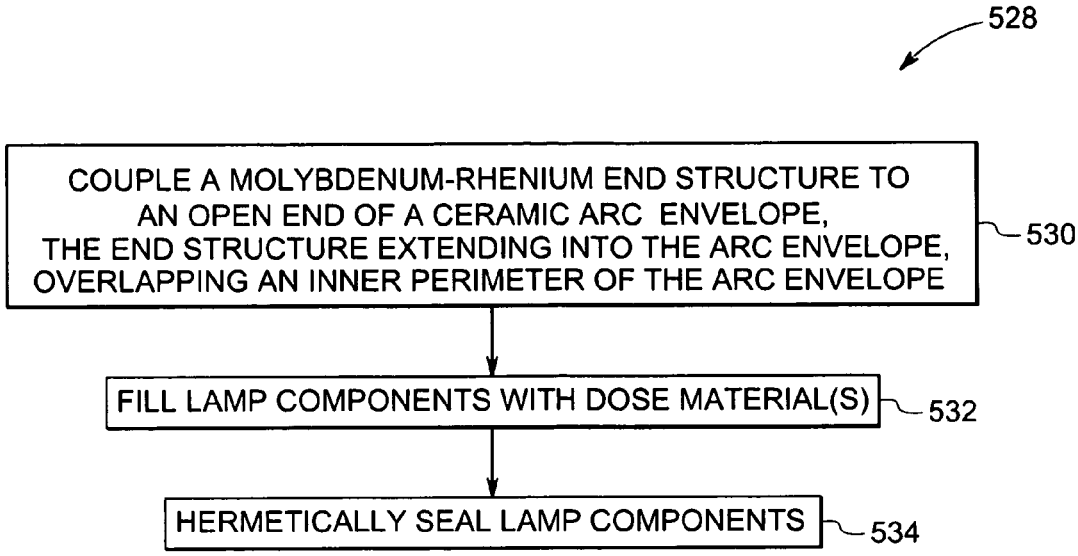
Figure 15:
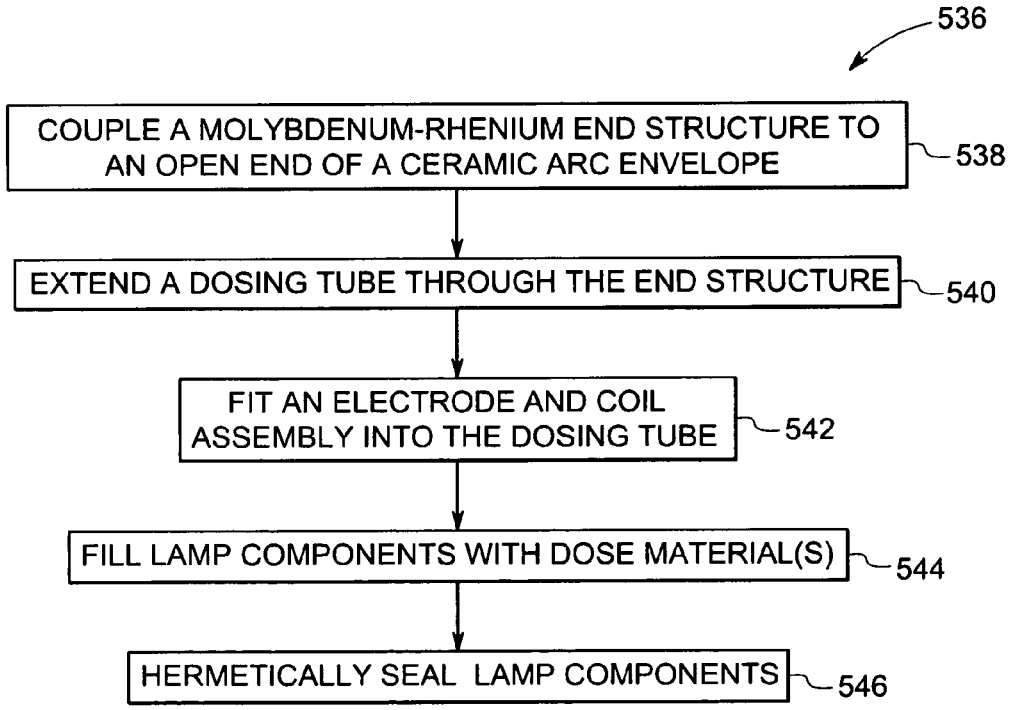
Figure 16:
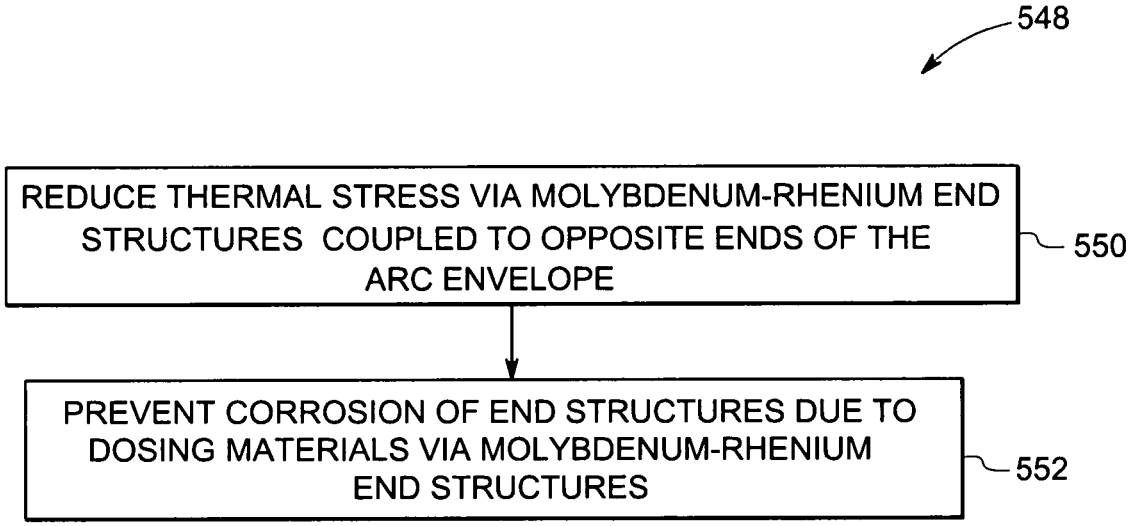

FIGS. 5, 6, 7, and 8 are cross-sectional views of the lamp illustrated in FIG. 3 further illustrating certain aspects of a method of manufacturing the lamp in accordance with embodiments of the present technique;

FIG. 9 is a cross-sectional view of a reflective lamp assembly having a lamp, such as illustrated in FIGS. 1-8, in accordance with certain embodiments of the present technique;

FIG. 10 is a perspective view of an video projection system having the reflective lamp assembly of FIG. 9 in accordance with certain embodiments of the present technique;

FIG. 11 is perspective view of a vehicle, such as an automobile, having the reflective lamp assembly of FIG. 9 in accordance with certain embodiments of the present technique;

FIGS. 12, 13, 14, and 15 are flowcharts illustrating various methods of manufacturing a lamp in accordance with certain embodiments of the present technique; and FIG. 16 is a flowchart illustrating a method of operating a lamp in accordance with certain embodiments of the present technique.

DETAILED DESCRIPTION

Embodiments of the present technique provide unique ceramic arc lamps comprising an arc envelope having a molybdenum-rhenium end structure, which improves performance and mechanical stability of the lamp. The metallic end structure design also desirably provides better thermal stress management during lamp start-up and better thermal management of cold spot temperature. In certain embodiments, these lamps include dosing tubes to facilitate dosing without the use of a hot furnace and dry box environment. In some embodiments, the concentration of rhenium in the molybdenum rhenium alloy is in a range from about 5% to about 60% by weight. In certain other embodiments, the rhenium concentration is in a range from about 10% to about 55% by weight. In some other embodiments, the rhenium concentration is in a range from about 38% to about 48%. The unique features introduced above are described in detail below with reference to figures of several exemplary embodiments of the present technique.

Figure 1:
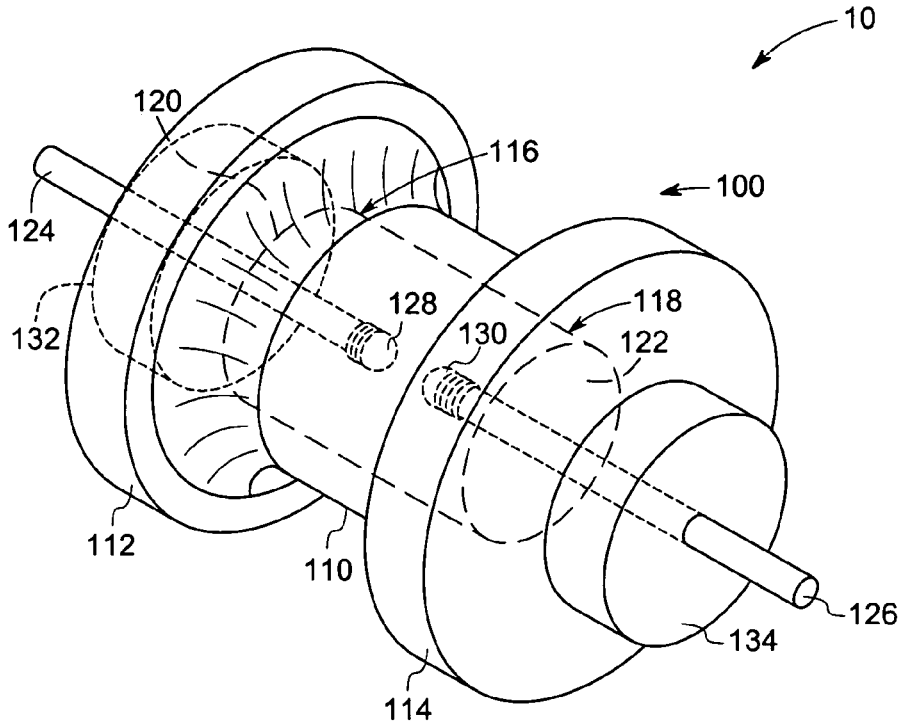
FIG. 1 is a perspective view of an exemplary lamp of the present technique.

Turning now to the drawings, FIG. 1 is a perspective view of a lamp 10 in accordance with certain embodiments of the present technique. As illustrated, the lamp 10 comprises a hermetically sealed assembly of a hollow body or arc envelope assembly 100. As discussed in further detail below, the arc envelope assembly 100 comprises an arc envelope 110 and molybdenum-rhenium end structures 112 and 114 coupled to opposite ends 116 and 118 of the arc envelope 110 and overlapping the arc envelope openings 120 and 122. The arc envelope assembly 100 also includes electrodes 124 and 126 having arc tips 128 and 130, respectively. These electrodes 124 and 126 are mounted inside the dosing tubes 132 and 134 that extend through the end structures 112 and 114, respectively.

These and other components of the lamp 10 are formed from a variety of materials, which are either identical or different from one another. For example, different embodiments of the arc envelope 110 are formed from a variety of transparent ceramics and other materials, such as micrograin polycrystalline alumina, alumina, single crystal sapphire, yttria, spinel, ytterbia and rare-earth aluminum garnets. Some useful (colorless) rare earth aluminum garnets include yttrium aluminum garnet, ytterbium aluminum garnet, lutetium aluminum garnet, and chemical combinations of such rare earth aluminum garnets. Other embodiments of the arc envelope 110 are formed from conventional lamp materials such as polycrystalline alumina (PCA). Regarding the geometry of the lamp 10, certain embodiments of the arc envelope 110 comprise a hollow cylinder, a hollow oval shape, a hollow sphere, a bulb shape, a rectangular shaped tube, or another suitable hollow transparent body.

The end structures 112 and 114 of the arc envelope assembly 100 are formed from suitable materials comprising molybdenum-rhenium alloys. End structures desirably provide stress distribution in the ceramic at the ends of the ceramic arc envelope 110. For certain embodiments, the dosing material encapsulated by the arc envelope 100 comprises a rare gas and mercury. In certain other embodiments, the dosing material is mercury-free. Further embodiments of the dosing material include materials such as but not limited to metals, or halides such as bromides, chlorides and iodides, or metal halides such as rare-earth metal halides, or any combinations thereof. At least a portion of the dosing material, typically the metal portion, emits radiation in a desired spectral range in response to being excited by an electrical discharge. In one embodiment, the molybdenum-rhenium end structures 112 and 114 are desirably resistant to corrosion from the dosing materials. In some embodiments, the molybdenum-rhenium end structures 112 and 114 act as radiation shields to reflect radiation emitted from within the arc envelope 110 back into and outwardly from the arc envelope 110. The lamp 10 may include a variety of additional structures such as reflectors and lens shaped structures to focus and direct light from the arc envelope assembly 100.

Figure 2:
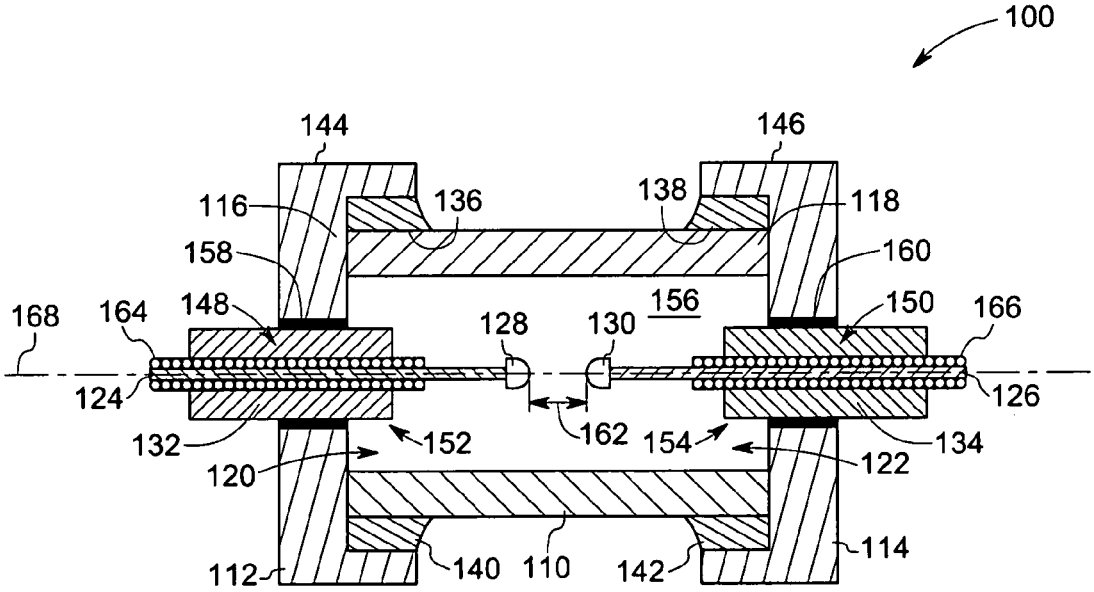
FIG. 2 is a cross-sectional view of a lamp having an arc envelope, end structures coupled to (and extending about) opposite ends of the arc envelope, and a dosing tube coupled to each end structure in accordance with embodiments of the present technique.

FIG. 2 is a cross-sectional view of the arc envelope assembly 100 in accordance with certain embodiments of the present technique. Again, the arc envelope assembly 100 comprises a hermetically sealed assembly of the hollow body or arc envelope 110 and molybdenum-rhenium end structures 112 and 114 coupled to opposite ends 116 and 118 of the arc envelope 110. In the illustrated embodiment, the end structures 112 and 114 abut the ends 116 and 118 and extend or wrap around outer circumferential portions 136 and 138 of the arc envelope 110. In addition, a compliant seal material 140 and 142 is applied between outer lips or wrapping portions 144 and 146 of the end structures 112 and 114 and outer circumferential portions 136 and 138 of the arc envelope 110.

A compliant seal material acts as a spring like material, enabling reduction of thermal shock and stress, especially under rapid temperature change or rapid thermal cycling conditions. Cold spots in a lamp are desirably reduced or substantially eliminated as dosing material may condense on these spots. Desirably, a seal material 140 and 142 used to seal the end structures 112 and 114 to the arc envelope 110 and the wrapping portions 144 and 146 of the end structures 112 and 114 enable uniform heat distribution in the arc envelope assembly, which helps reduce the likelihood or degree of cold spots, e.g., typically found away from the discharge arc in the vicinity of the end structures and dosing tubes. The seal materials 140 and 142 can include a sealing glass, such as calcium aluminate, dysprosia-alumina-silica (DAS), magnesia-alumina-silica, yttria-alumina-silica (YAS), or yttria-calcia-alumina. The sealing operation can be performed in an isothermal sintering furnace using a designed seal process cycle. In embodiments, where radio frequency (RF) heating is used in the sealing operation, the molybdenum-rhenium end structures 112 and 114 can be the susceptor. A susceptor desirably acts as a thermal collection and distribution device, which when heated by a source refocuses the heat to melt the sealing material. Other sealing techniques such as temperature gradient sealing or laser sealing may also be desirably used to seal the molybdenum-rhenium end-structures 112 and 114 to the ceramic arc envelope 110.

The arc envelope assembly 100 of FIG. 2 includes electrodes 124 and 126 having arc tips 128 and 130, respectively. The arc envelope assembly 100 also includes dosing tubes 132 and 134 mounted to passages 148 and 150 through the end structures 112 and 114, respectively. As discussed in detail below, these dosing tubes 132 and 136 facilitate insertion of dosing materials into the arc envelope 110. In the illustrated embodiment, portions 152 and 154 of the dosing tubes 132 and 134 respectively, extend into the arc envelope cavity 156 at the opposite ends 116 and 118 of the arc envelope 110. Seal material 158 and 160 seal the dosing tubes 132 and 134 to the end structures 112 and 114. In certain embodiments, the dosing tubes 132 and 134 are sealed to the end structure 112 and 114 without extending into the arc envelope cavity 156. In some embodiments, the dosing tube comprises a molybdenum-rhenium material. In certain other embodiments, the molybdenum-rhenium dosing tubes 132 and 134 are welded (e.g., laser welded) to the molybdenum-rhenium end structures 112 and 114. In further embodiments, the end structure 112 and dosing tube 132 are a single integral or one-piece structure made of the molybdenum-rhenium material, and the end structure 114 and dosing tube 114 are a single integral or one-piece structure made of the molybdenum-rhenium material. A molybdenum-rhenium material has the advantage of being resistant to corrosive dosing materials and is sufficiently ductile to allow sealing via a crimping process, a cold welding process, or any other suitable mechanical deformation technique.

In certain embodiments, the electrodes 124 and 126 comprise tungsten or molybdenum. However, other materials are within the scope of the present technique. The electrodes 124 and 126 are mounted to the dosing tubes 132 and 134, such that the arc tips 128 and 130 are separated by a gap 162 to create an arc during operation. Advantageously, the position of the electrodes 124 and 126 can be adjusted lengthwise through the dosing tubes 132 and 134 to attain the desired gap 162 with relatively high precision.

The illustrated arc envelope assembly 100 also includes coils 164 and 166 surrounding the electrodes 124 and 126 within the dosing tubes 132 and 134, respectively. The coils 164 and 166 support the electrodes 124 and 126 in a radial direction within the dosing tubes 132 and 134 respectively, while also permitting some freedom of axial movement and stress relaxation of the respective components. In certain embodiments, the coils 164 and 166 each comprise a molybdenum-rhenium coil assembly having a molybdenum-rhenium mandrel with a molybdenum-rhenium wire over-wrap that is continuously wound on the mandrel. In certain embodiments, the electrode is disposed within or on the coil. In certain other embodiments, the electrode is disposed within, and attached or welded to the coil. In some embodiments, the electrode is attached or welded to one end of the coil. In a further embodiment, electrode assemblies comprising tungsten electrodes 124 and 126 welded to molybdenum-rhenium coils 164 and 166 are fitted into molybdenum-rhenium dosing tubes 132 and 134, respectively. The molybdenum-rhenium coil assembly eases insertion of electrodes into the molybdenum-rhenium tube allowing precise arc gap 162 control during assembly of the lamp and presents a compliant structure, which can help manage the thermal stresses during heat up and cool down of the lamp. The compliant nature of the molybdenum-rhenium coil enables it to yield and accommodate under varying stress conditions, whereby the coil behaves like a spring like structure enabling it to deal with thermal shock and stress, especially under rapid temperature change or rapid thermal cycling conditions.

In the illustrated embodiment, the arc tips 128 and 130 are oriented along the centerline 168 of the arc envelope 110. However, alternative embodiments of the electrodes 124 and 126 position the arc tips 128 and 130 offset from the centerline 168, such that the arc created during operation is substantially centered within the arc envelope 110. For example, alternative electrodes 128 and 130 may be angled outwardly from the centerline 168 and/or mounted to the end structures 112 and 114 at positions offset from the centerline 168.

FIG. 3 is a cross-sectional view of an arc envelope assembly 200 in accordance with certain embodiments of the present technique. Similar to the embodiment of FIG. 2, the illustrated arc envelope assembly 200 includes a ceramic arc envelope 210, opposite end structures 212 and 214 coupled to opposite ends 216 and 218 of the arc envelope 210, molybdenum-rhenium dosing tubes 232 and 234 extending through and sealed 258 and 260 with passages 248 and 250 in the end structures 212 and 214, and tungsten electrodes 224 and 226 having molybdenum-rhenium coils 264 and 266 extending along a centerline 268 through the dosing tubes 232 and 234 to arc tips 228 and 230, respectively, separated by an arc gap 262 within the arc envelope cavity 256. In the illustrated embodiment of FIG. 3, the end structures 212 and 214 further include end structure portions 270 and 272 extending into the arc envelope cavity 256, thereby overlapping an internal perimeter 274 of the arc envelope 210 and surround portions 276 and 278 of the dosing tubes 232 and 234, respectively.

Figure 4:
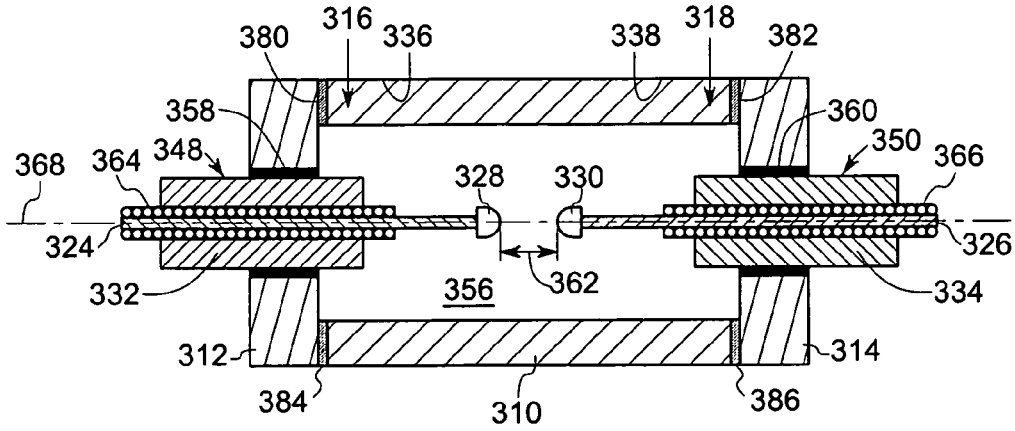
FIG. 4 is a cross-sectional view of a lamp having an arc envelope, end structures butt-sealed to (i.e., without extending about or into) opposite ends of the arc envelope, and a dosing tube coupled to each end structure in accordance with embodiments of the present technique.

FIG. 4 is a cross-sectional view of an arc envelope assembly 300 in accordance with certain embodiments of the present technique. Similar to the embodiments of FIGS. 2 and 3, the illustrated arc envelope assembly 300 includes a ceramic arc envelope 310, opposite end structures 312 and 314 coupled to opposite ends 316 and 318 of the arc envelope 310, molybdenum-rhenium dosing tubes 332 and 334 extending through and sealed 358 and 360 with passages 348 and 350 in the end structures 312 and 314, and tungsten electrodes 324 and 326 having molybdenum-rhenium coils 364 and 366 extending along a centerline 368 through the dosing tubes 332 and 334 to arc tips 328 and 330, respectively, separated by an arc gap 362 within the arc envelope cavity 356. In the illustrated embodiment of FIG. 4, the molybdenum-rhenium end structures 312 and 314 have substantially flat mating surfaces 380 and 382, which seal against the opposite ends 316 and 318 without wrapping around the outer circumference 336 and 338 of the arc envelope 310 or extending into the arc envelope cavity 356. In other words, the ends structures 312 and 314 butt-seal or form an end-to-end seal against the opposite ends 316 and 318. In certain embodiments, the end structures 312 and 314 are bonded to opposite ends 316 and 318 of the arc envelope 310 using a seal material. Localized heating (e.g., a laser) may be applied to the interface between the end structures 312 and 314 and the opposite ends 316 and 326 of the arc envelope 310 to further bond the materials together, thereby forming hermetical seals 384 and 386.

FIGS. 5-8 are cross-sectional side views of the arc envelope assembly 200 illustrated in FIG. 2 further illustrating a material dosing and sealing process in accordance with embodiments of the present technique. However, the process is also applicable to other forms of the arc envelope assembly, such as the arc envelope assemblies 200 and 300 illustrated in FIGS. 3 and 4. In the illustrated embodiment of FIG. 5, the arc envelope assembly 100 has two dosing tubes 132 and 134, one of which is used for injecting the dosing material into the arc envelope assembly 100. As discussed in further detail below, the dosing tubes 132 and 134 of FIG. 3 are sealed about the coils 164 and 166 and the electrodes 124 and 126, respectively. In certain embodiments, sealing is achieved by cold-welding the dosing tubes 132 and 134 about the coils 164 and 166 and the electrodes 124 and 126, respectively. For example, a crimping tool may compress the dosing tubes 132 and 134 about the coils 164 and 166 and the electrodes 124 and 126, respectively. In other embodiments, the sealing is achieved by applying localized heat, such as a laser beam, onto the dosing tubes 132 and 134, the coils 164 and 166, and the electrodes 124 and 126, respectively. In some embodiments, a seal material may be used to hermetically join the dosing tubes 132 and 134 to the end structures 112 and 114 and/or the arc envelope 110.

Figure 5:
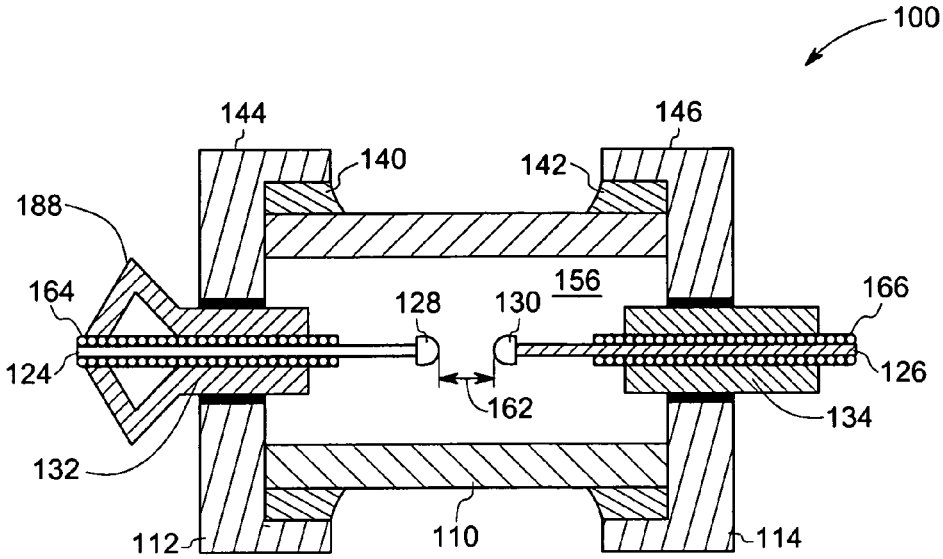
Figure 6:
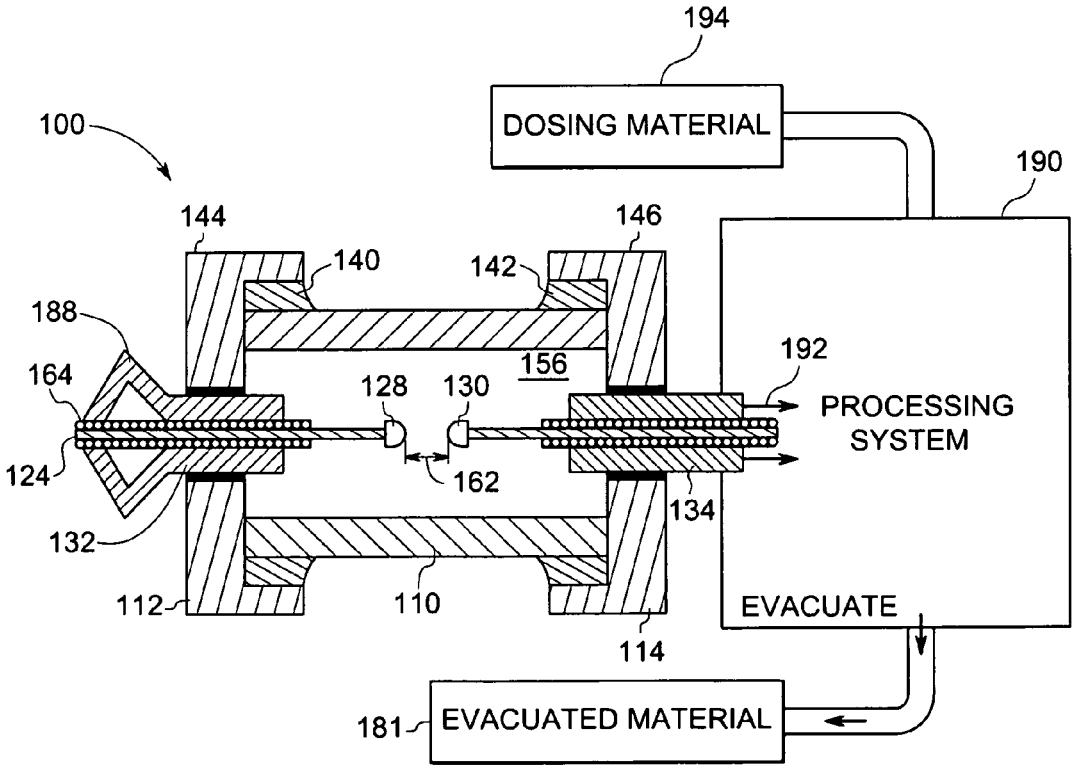
Figure 7:
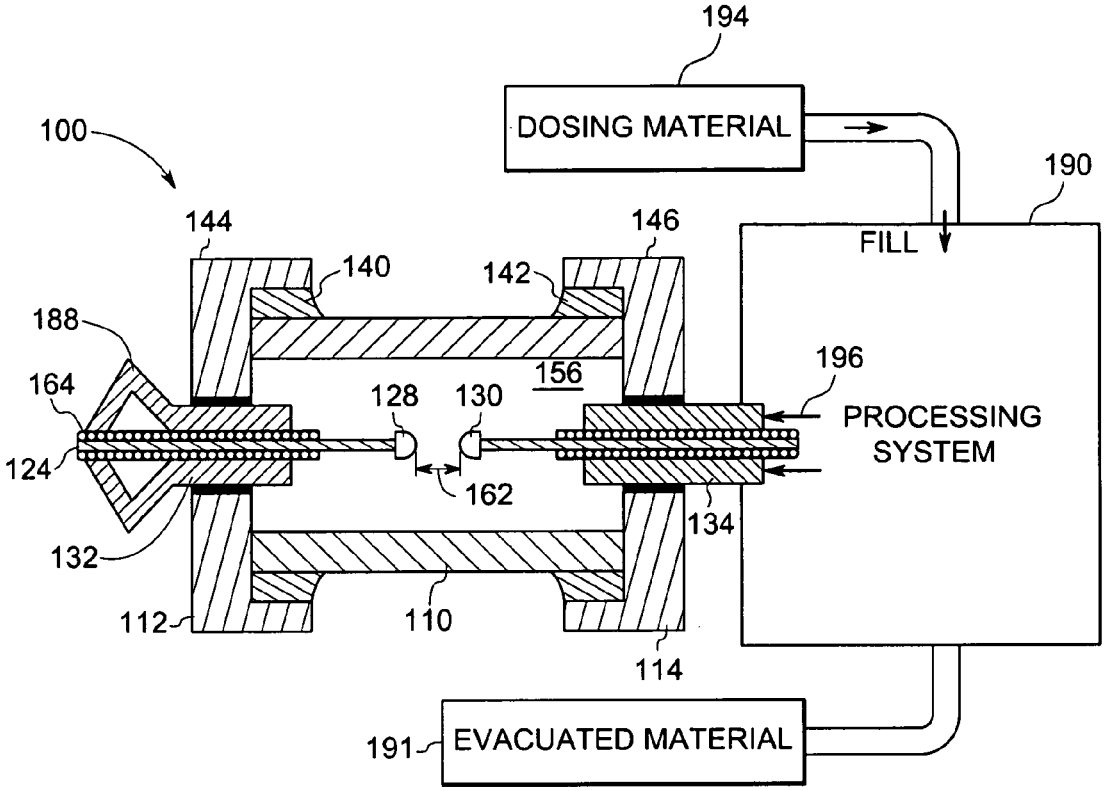

Accordingly, as illustrated in FIG. 5, the dosing tube 132 is closed via a cold welding or crimping operation to form a hermetical seal 188. For example, the dosing tube 132 may embody a molybdenum-rhenium alloy, which is mechanically compressed via a crimping tool or other mechanical deformation tool. Desirably, heat can also be applied (e.g., a laser weld) to facilitate a stronger bond at the hermetical seal 188. Once the dosing tube 132 is sealed at the hermetical seal 188, the arc envelope assembly 100 may be coupled to one or more processing systems to provide a desired dosing material in the arc envelope assembly 100. In the illustrated embodiment of FIG. 6, the processing system 190 operates to evacuate any substance 191 currently in the arc envelope 110, as indicated by arrows 192. For example, tubing can be connected between the processing system 190 and the dosing tube 134. Once the arc envelope assembly 100 is evacuated, the processing system 190 proceeds to inject one or more dosing materials 194 into the arc envelope 110, as illustrated by arrows 196 shown in FIG. 7. For example, the dosing materials 194 may comprise a rare gas, mercury, a halide, a metal, a metal halide and so forth.

Furthermore, the dosing materials 194 may be injected into the arc envelope 110 in the form of a gas, a liquid, or a solid, such as a dosing pill. After the desired dosing materials have been injected into the arc envelope 110, the present technique proceeds to close the remaining dosing tube 134, as illustrated in FIG. 8. For example, as described above, the dosing tube 134 may embody molybdenum-rhenium alloy, which is mechanically compressed via a crimping tool or other mechanical deformation tool to form a hermetical seal 198. In addition, localized heat, such as a laser, may be applied to the hermetical seal 198 to improve the bond and closure of the seal 198. Moreover, a seal material may be used to further improve the bond and close off the seal 198.

FIGS. 9, 10, 11 are exemplary systems in accordance with certain embodiments of the present technique. FIG. 9 illustrates an embodiment of a reflective lamp assembly 400 comprising the arc envelope assembly 100 of FIG. 8. As illustrated, the reflective lamp assembly 400 comprises an enclosure 402 having a curved reflective surface 404, a central rear passage or mounting neck 406, and a front light opening 408. The arc envelope assembly 100 is mounted in the mounting neck 406, such that light rays 412 are directed outwardly from the assembly 100 toward the generally curved reflective surface 404. The curved surface 404 then redirects the light rays 412 forward toward the front light opening 408 as indicated by arrows 414. At the front light opening 408, the illustrated reflective lamp assembly 100 also includes a transparent or translucent cover 410, which may be a flat or lens-shaped structure to focus and direct the light from the arc envelope assembly 100. Moreover, the cover 410 may include coloring, such as red, blue, green, or a combination thereof. In some embodiments, the reflective lamp assembly may include suitable electronic components for starting and operating the lamp. The electronic components may be housed in a separate housing or in an integrated housing with other reflective lamp assembly components and may include fixtures. The electronic components may further include a ballast circuit. In certain embodiments, the reflective lamp assembly 400 may be incorporated or adapted to a variety of applications, such as transportation systems, video systems, outdoor lighting systems, and so forth. In some further embodiments, For example, FIG. 10 illustrates an embodiment of a video projection system 420 comprising the reflective lamp assembly 400 illustrated in FIG. 9. By further example, FIG. 11 illustrates a vehicle 422, such as an automobile, having a pair of the reflective lamp assemblies 400 in accordance with certain embodiments of the present technique. Other embodiments of the reflective lamp assembly include but are not limited to reflective lamp assemblies for street lighting, industrial lighting, flood lighting, and specialty lighting including stage, studio and stadium lighting.

Embodiments of the present technique also provide methods of making a molybdenum-rhenium end structure and lamps incorporating the same. In some embodiments, a machining method is employed to make the molybdenum-rhenium end structure. For example, a rod of the molybdenum-rhenium alloy is machined to manufacture an end structure with a desired shape. In certain other embodiments, a press forming method is used to manufacture the end structure. Examples of press forming include press forming from a rod or a rolled sheet. In certain embodiments a powder process method is employed to make the molybdenum-rhenium end structure. Powder process methods typically include the steps of forming a powder of molybdenum-rhenium material, passing the powder through a mold or die to form a structure similar in shape to the desired final structure, and subjecting the structure to high pressure, or high temperature, or long setting times or any combinations thereof to obtain the desired molybdenum rhenium end structure. Powder process methods include cold pressing, sintering, hot isotatic pressing, injection molding, and forging.

Figure 12:
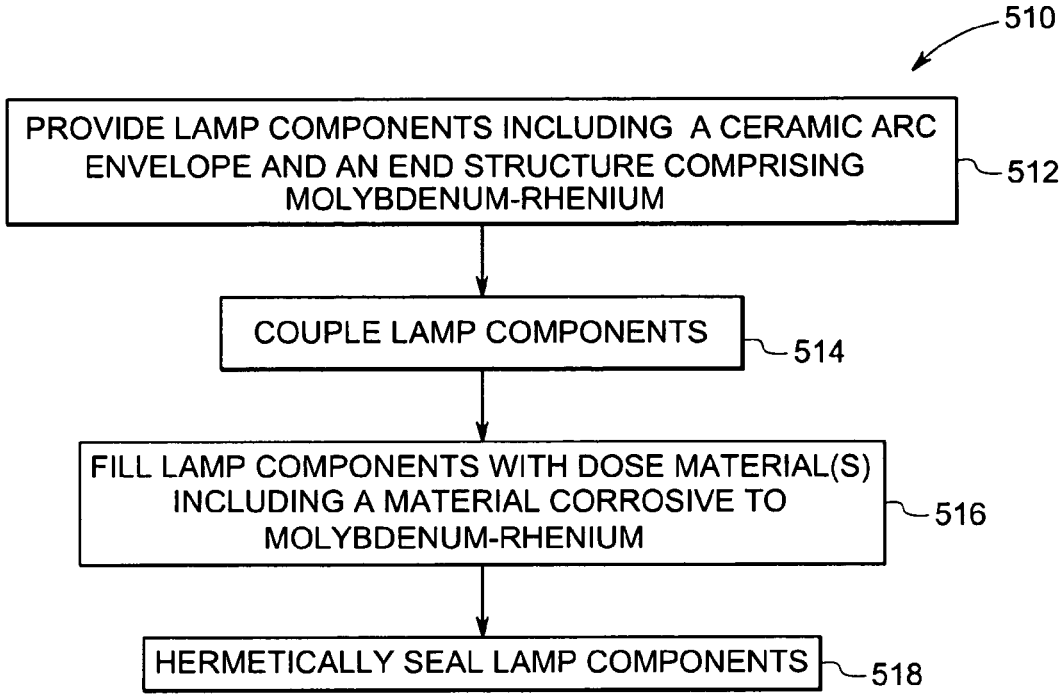
Figure 13:
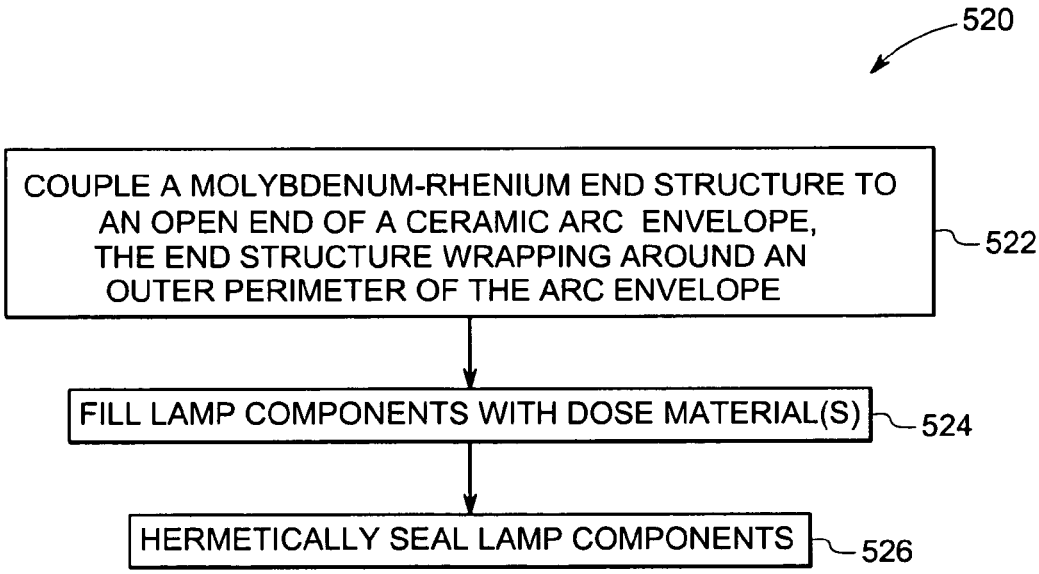

Turning now to FIGS. 12, 13, and 14, these figures illustrate exemplary processes for manufacturing the lamps and systems described above with reference to FIGS. 1-11. FIG. 12 is a flow chart illustrating a process 510 for manufacturing the lamp 10 in accordance with embodiments of the present technique. As illustrated, the process 510 proceeds by providing lamp components including a ceramic arc envelope and an end structure comprising molybdenum-rhenium (block 512). At block 514, the process 510 continues by coupling lamp components. For example, the lamp components may be coupled together in a configuration, wherein the end structure is coupled to the arc envelope to provide mechanical stability and to reduce thermal stress in the arc envelope assembly during operation, e.g., as discussed above with reference to FIGS. 2-4. The process 510 then proceeds by filling the lamp components with dose material(s) including a material corrosive to molybdenum-rhenium (block 516). For example, the dosing materials may include mercury, sodium, indium, thallium, scandium, halides of rare earth elements such as dysprosium, holmium, thulium, and inert gases such as krypton, argon or xenon. The process step 516 of filling lamp components with dosing material also may comprise the act of cold dosing the lamp at high pressure with the dosing material. The evacuation and dosing material fill process may be performed by attaching the dosing tube to a suitable processing station, as opposed to handling the assembly in a dry box and/or furnace. The process 510 then proceeds by hermetically sealing the lamp components (block 518). For example, the sealing process may include applying a seal material, localized heating, pressure (e.g., a crimping tool), or other sealing techniques at one or more joints between the lamp components.

FIG. 13 illustrates another process 520 for manufacturing the lamp 10 in accordance with embodiments of the present technique. As illustrated, the process 520 begins by coupling a molybdenum-rhenium end structure to an open end of a ceramic arc envelope (block 522). For example, the end structure is sealed around an outer circumferential portion (i.e., wrapping around the exterior) of the arc envelope using a suitable seal material. The process 520 proceeds by filling the lamp components with dose material(s) (block 524). The process then proceeds to hermetically seal lamp components (block 526).

FIG. 14 illustrates another process 528 for manufacturing the lamp 10 in accordance with embodiments of the present technique. As illustrated, the process 528 begins by coupling a molybdenum-rhenium end structure to an open end of a ceramic arc envelope (block 530). For example, the end structure is sealed with an end structure portion extending into (or plugging within) the open end of the arc envelope. The process 528 proceeds by filling the lamp components with dose material(s) (block 532). The process then proceeds to hermetically seal lamp components (block 534).

FIG. 15 is a flow chart illustrating a process 536 for manufacturing the lamp 10 in accordance with embodiments of the present technique. As illustrated, the process 536 proceeds by coupling a molybdenum-rhenium end structure to an open end of a ceramic arc envelope (block 538). At block 540, the process 530 continues by extending a dosing tube (e.g., a molybdenum-rhenium dosing tube) through the end structure and sealing the dosing tube to the end structure. In certain embodiments, blocks 538 and 540 include a single step of coupling a molybdenum-rhenium end structure to the open end of the ceramic arc envelope, wherein the end structure includes an integral dosing tube (i.e., a one-piece structure). The process 536 then proceeds by fitting an electrode and coil assembly into the dosing tube (block 542). For example, the electrode and coil assembly may include a tungsten electrode and a molybdenum-rhenium coil wrapped around the tungsten electrode. The process 536 then continues by filling the lamp components with desired dose material(s) (block 544). The process 530 then proceeds by sealing the lamp components (block 546). For example, the sealing process may include applying a seal material, localized heating, pressure (e.g., a crimping tool), or other sealing techniques at one or more joints between the lamp components.

FIG. 16 is a flow chart illustrating an exemplary process 548 of lamp operation in accordance with embodiments of the present technique. The process 548 reduces thermal stress via molybdenum-rhenium end structures coupled to opposite ends of the arc envelope (block 550). For example, the molybdenum-rhenium end structures reduce thermal shock in dynamic lighting applications, improve startup, help control cold spots near the opposite ends of the arc envelope, and provide mechanical stability to the arc envelope assembly. Many dosing materials although efficient radiation emitters, are also corrosive to end structure materials such as niobium. The process 550 prevents corrosion of end structures due to the dosing material by using molybdenum rhenium based end structure material (552).

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A lamp, comprising:

an arc envelope;

a dosing material disposed within the arc envelope; and an end structure comprising arc tips that are separated by an adjustable gap, wherein the end structure is coupled to the arc envelope at a planar interface, and wherein the end structure consists essentially of a molybdenum-rhenium material.

2. The lamp of claim 1, comprising a dosing tube extending through the end structure.

3. The lamp of claim 2, wherein the dosing tube comprises a molybdenum-rhenium material.

4. The lamp of claim 2, comprising a coil disposed in the dosing tube and an electrode disposed within or on the coil.

5. The lamp of claim 4, wherein the coil comprises a molybdenum-rhenium material.

6. The lamp of claim 1, wherein the end structure overlaps an outer perimeter of the arc envelope.

7. The lamp of claim 1, wherein the end structure extends into the arc envelope and overlaps an inner perimeter of the arc envelope.

8. The lamp of claim 1, wherein the end structure is coupled to the arc envelope only at the planar interface.

9. The lamp of claim 1, comprising a compliant seal material disposed between the arc envelope and the end structure.

10. The lamp of claim 1, wherein the dosing material comprises a metal, or a halide, or a metal halide, or mercury, or sodium, or sodium iodide, or thallium iodide, or dysprosium iodide, or holmium iodide, or thulium iodide, or a noble gas, or argon, or krypton, or xenon, or any combinations thereof.

11. The lamp of claim 1, wherein the dosing material is mercury-free.

12. The lamp of claim 1, wherein a concentration of rhenium in the molybdenum-rhenium material is in a range from about 10% to about 55% by weight.

13. The lamp of claim 1, wherein a concentration of rhenium in the molybdenum-rhenium material is in a range from about 38% to about 48% by weight.

14. A system, comprising:

a lamp, comprising:

an end structure comprising electrodes comprising arc tips that are separated by an adjustable gap, wherein the end structure consists essentially of molybdenum-rhenium;

a ceramic arc envelope coupled to the end structure at an interface via a compliant seal material, wherein the interface is crosswise to a longitudinal axis of the ceramic arc envelope;

a dosing tube extending through the end structure;

a coil disposed in the dosing tube, wherein the electrodes are disposed within or on the coil; and a dosing material disposed within the arc envelope.

15. The system of claim 14, wherein the dosing tube comprises a molybdenum-rhenium material.

16. The system of claim 14, wherein the coil comprises a molybdenum-rhenium material.

17. The system of claim 14, comprising a reflective lamp assembly including the lamp.

18. The system of claim 17, comprising a vehicle having the reflective lamp assembly.

19. The system of claim 14, comprising a video projector having the lamp.

20. The system of claim 14, wherein the dosing material comprises a metal, or a halide, or a metal halide, or mercury, or sodium, or sodium iodide, or thallium iodide, or dysprosium iodide, or holmium iodide, or thulium iodide, or a noble gas, or argon, or krypton, or xenon, or combinations thereof.

21. The system of claim 14, wherein the dosing material is mercury-free.

22. The system of claim 14, wherein the interface comprises a planar interface.

23. A method of making a lamp, comprising the acts of:

providing a ceramic arc envelope and an end structure comprising arc tips that are separated by an adjustable gap, wherein the end structure consists essentially of molybdenum-rhenium; and sealing the ceramic arc envelope and the molybdenum-rhenium end structure at a planar interface having a compliant seal material.

24. The method of claim 23, comprising the act of providing a dosing tube extending through the molybdenum-rhenium end structure, a coil disposed inside the dosing tube, and an electrode disposed within or on the coil.

25. The method of claim 24, wherein the dosing tube, or the coil, or both comprise a molybdenum-rhenium material.

26. The method claim 24, comprising the act of sealing the dosing tube via localized heating, or cold welding, or a combination thereof.

27. The method of claim 23, comprising the act of cold dosing the lamp at high pressure with a dosing material.

28. The method of claim 23, wherein the dosing material excludes mercury.

29. A method of operating a lamp comprising:

creating an electrical arc between a pair of electrode tips that are separated by an adjustable gap, to initiate a discharge in a dosing material disposed within an arc envelope; and reducing thermal stress via end structures that consist essentially of molybdenum-rhenium and are coupled to opposite planar ends of the arc envelope.

30. A lamp comprising:

an arc envelope; and an end structure comprising arc tips that are separated by an adjustable gap, wherein the end structure abuts and seats with an outermost end of the arc envelope;

wherein the end structure consists essentially of molybdenum-rhenium.

31. The lamp of claim 30, wherein the outermost end comprises a planar end surface.

* * * * *

UNITED STATES PATENT AND TRADEMARK OFFICE

CERTIFICATE OF CORRECTION

PATENT NO. : 7,852,006 B2
APPLICATION NO. : 11/172649
DATED : December 14, 2010
INVENTOR(S) : Bewlay et al.

It is certified that error appears in the above-identified patent and that said Letters Patent is hereby corrected as shown below:

On the Face Page, in Figure, above Tag "382" insert -- 300 --.

In Fig 4, Sheet 2 of 9, above Tag "382" insert -- 300 --.

In Column 8, Line 4, delete "isotatic" and insert -- isostatic --, therefor.

In Column 10, Line 53, in Claim 26, delete "method" and insert -- method of --, therefor.

In Column 11, Line 4, in Claim 30, delete "seats" and insert -- seals --, therefor.

Signed and Sealed this
Fourteenth Day of June, 2011

David J. Kappos

David J. Kappos
*Director of the United States Patent and Trademark Office*